US009739032B2

(12) United States Patent
Berndt

(10) Patent No.: US 9,739,032 B2
(45) Date of Patent: Aug. 22, 2017

(54) SELF CLEANING COLLECTION APPARATUS AND METHOD

(71) Applicant: Nautilus Minerals Pacific Pty Ltd, Milton, Queensland (AU)

(72) Inventor: Roland Berndt, Milton (AU)

(73) Assignee: Eda Kopa (Solwara) Limited, Port Moresby (PG)

( * ) Notice: Subject to any disclaimer, the term of this patent is extended or adjusted under 35 U.S.C. 154(b) by 0 days.

(21) Appl. No.: 14/416,627

(22) PCT Filed: Jun. 25, 2013

(86) PCT No.: PCT/AU2013/000677
§ 371 (c)(1),
(2) Date: Jan. 22, 2015

(87) PCT Pub. No.: WO2014/015361
PCT Pub. Date: Jan. 30, 2014

(65) Prior Publication Data

US 2015/0184358 A1 Jul. 2, 2015

(30) Foreign Application Priority Data

Jul. 27, 2012 (AU) ..... 2012903244

(51) Int. Cl.
*E02F 3/92* (2006.01)
*E21C 50/00* (2006.01)
(Continued)

(52) U.S. Cl.
CPC ..... *E02F 3/9293* (2013.01); *B07B 1/15* (2013.01); *B07B 1/526* (2013.01); *B07B 1/528* (2013.01);
(Continued)

(58) Field of Classification Search
CPC ..... E02F 3/92; E02F 3/9212; E02F 3/9237; E02F 3/9256; E02F 3/9293; E02F 3/94;
(Continued)

(56) References Cited

U.S. PATENT DOCUMENTS 1,729,054 A * 9/1929 Shotwell ..... E02F 3/9212 209/250
2,446,573 A 8/1948 Cameron
(Continued)

FOREIGN PATENT DOCUMENTS

DE 202006005070 7/2006
FR 2638178 A1 4/1990
(Continued)

*Primary Examiner* — Jamie L McGowan
(74) *Attorney, Agent, or Firm* — McDonnell Boehnen Hulbert & Berghoff LLP

(57) ABSTRACT

A self cleaning collecting apparatus and method are provided for the collection of seafloor material. The collecting apparatus, which operates on a seafloor, has a plurality of rotating discs in front of a slurry suction pipe with clearing members located between adjacent discs. Any oversize material lodged in the discs during collection is dislodged by the one or more clearing members and prevented from entering the slurry suction pipe, thus preventing blockages caused by oversize material congesting the slurry suction pipe.

25 Claims, 5 Drawing Sheets

(51) Int. Cl.

| | |
|---|---|
| ***E02F 3/18*** | (2006.01) |
| ***E02F 3/24*** | (2006.01) |
| ***E02F 5/00*** | (2006.01) |
| ***B07B 1/52*** | (2006.01) |
| ***B07B 1/15*** | (2006.01) |
| ***E02F 3/88*** | (2006.01) |

(52) U.S. Cl.
CPC ..... *E02F 3/181* (2013.01); *E02F 3/248* (2013.01); *E02F 3/8858* (2013.01); *E02F 3/9237* (2013.01); *E02F 5/006* (2013.01); *E21C 50/00* (2013.01)

(58) Field of Classification Search
CPC ..... E02F 3/181; E02F 3/248; E02F 3/8858; E02F 5/00; E21C 50/00; B07B 1/528; B07B 1/15; B07B 1/526
See application file for complete search history.

(56) References Cited

U.S. PATENT DOCUMENTS 3,226,854 A * 1/1966 Mero ..... E02F 3/905 37/314
3,371,975 A 3/1968 Meltzer
3,556,598 A * 1/1971 Smith ..... E02F 3/92 299/8
3,972,566 A 8/1976 Brockett et al.
3,988,843 A * 11/1976 Brockett, III ..... E21C 50/00 37/314
4,004,359 A * 1/1977 Klip ..... E02F 3/9237 37/319
4,083,134 A 4/1978 Oterdoom
4,232,903 A * 11/1980 Welling ..... E02F 3/8858 241/1
4,259,795 A * 4/1981 Verboom ..... E02F 3/9237 37/329
4,521,305 A * 6/1985 Deal ..... B01D 33/073 210/158
4,652,055 A 3/1987 Amann et al.
4,896,445 A * 1/1990 Deal ..... E02F 3/88 37/195
4,999,934 A * 3/1991 Hanson ..... E02F 3/88 37/189
5,146,699 A * 9/1992 Lipford ..... E02F 3/92 210/388
5,421,105 A * 6/1995 Schulte ..... E02F 3/963 37/309
5,651,200 A * 7/1997 Walsh ..... E02F 3/94 37/318
9,243,496 B2 * 1/2016 Jones ..... E02F 3/20
2011/0239493 A1 * 10/2011 Tack ..... E02F 3/9212 37/333
2013/0298430 A1 * 11/2013 Jones ..... E02F 3/20 37/313
2015/0008719 A1 * 1/2015 Merrell ..... E21C 50/00 299/9
2015/0184358 A1 * 7/2015 Berndt ..... E21C 50/00 37/318

FOREIGN PATENT DOCUMENTS

| | | |
|---|---|---|
| JP | 59-004728 A | 1/1984 |
| JP | 2001504031 | 3/2001 |
| NL | 8800565 | 10/1989 |
| WO | 98/51395 A1 | 11/1998 |
| WO | 2004/089557 A1 | 10/2004 |
| WO | 2011156866 | 12/2011 |

* cited by examiner

SELF CLEANING COLLECTION APPARATUS AND METHOD

This application is a US national phase of International Application No. PCT/AU2013/000677 filed on Jun. 25, 2013, which claims priority to Australian Patent Application No. 2012903244 filed on Jul. 27, 2012.

FIELD OF THE INVENTION

The present invention relates generally to seafloor mining and collection operations. In particular the invention relates, but is not limited, to a seafloor collecting apparatus.

BACKGROUND TO THE INVENTION

Seabed excavation is often performed by dredging, for example to retrieve valuable alluvial placer deposits or to keep waterways navigable. Suction dredging involves positioning a gathering end of a pipe or tube close to the seabed material to be excavated, and using a surface pump to generate a negative differential pressure to draw water and nearby seafloor sediment into and up the pipe. Cutter suction dredging further provides a cutter head at or near the suction inlet to release compacted soils, gravels or even hard rock, to be drawn into the pipe.

A problem with prior art dredging devices is that the suction inlet or pipe can become blocked with large chunks of 'oversize' material. One method for preventing oversize material from blocking the pipe is to place a screen over the inlet end of the pipe. However, this typically just transfers the problem to the screen, and oversize material can collect on the screen causing a blockage at the inlet.

Any such blockages are highly undesirable as they reduce efficiency of the operations. At significant water depths, e.g. over 1000 m, they can become particularly problematic as it is not possible to readily perform maintenance or retrieve the device to the surface.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

OBJECT OF THE INVENTION

It is an object of the invention to overcome or at least alleviate one or more of the above problems and/or provide the consumer with a useful or commercial choice.

Other preferred objects of the present invention will become apparent from the following description.

SUMMARY OF INVENTION

In one form, although it need not be the only or indeed the broadest form, the invention resides in a collecting apparatus that operates on a seafloor, the apparatus comprising a plurality of discs disposed in front of a slurry suction pipe and one or more clearing members, each of the one or more clearing members being located at least partially between adjacent discs of the plurality of discs.

Preferably, the plurality of discs are attached to a shaft. Typically the shaft is operatively connected to at least one motor. Preferably the plurality of discs are spaced uniformly along at least a portion of the shaft. Preferably adjacent discs of the plurality of discs are spaced from one another at a predetermined distance corresponding to a predetermined maximum size of material to be drawn into the slurry suction pipe. The plurality of discs are preferably located adjacent a rear housing panel that also limits the particle size drawn into the slurry suction pipe.

Preferably, at least one auger is disposed adjacent to the plurality of discs. More preferably, at least one auger is attached to the shaft. Preferably the auger is arranged to urge material in a direction parallel to the axis of the shaft. Preferably the direction parallel to the axis of the shaft is toward the plurality of discs. In a preferred form, two augers are attached to the shaft, one on either side of the plurality of discs. The two augers are preferably arranged in an opposed configuration such that they both draw material along the axis of the shaft towards the plurality of discs between them.

Preferably the slurry inlet is a suction inlet. Typically the collecting apparatus comprises a pump fluidly connected to the slurry inlet. The slurry inlet may have a screen that limits material over a predetermined size being drawn into the slurry inlet. However, in a preferred form the slurry inlet does not have a screen and is arranged such that the plurality of discs and the one or more clearing members limit material over a predetermined size being drawn into the slurry inlet. Preferably the one or more clearing members are arranged such that material over the predetermined size is passed over the top of the clearing member and plurality of discs where it preferably falls behind the collecting apparatus so that oversize material does not hold up progress of seafloor collection activities.

Preferably the one or more clearing members are a plurality of clearing members. More preferably, the number of clearing members corresponds to the number of spaces between the plurality of discs, with one clearing member being disposed between each pair of adjacent discs. Typically, each of the one or more clearing members is attached to a support member.

Preferably each of the one or more clearing members is in the form of a finger. The one or more clearing members are preferably integrally formed with a support member to form a clearing comb that has a plurality of fingers. The clearing comb is preferably mounted adjacent the plurality of discs such that a finger is located between each pair of adjacent discs. Preferably the clearing comb is mounted in front of the slurry inlet with respect to a forward direction of travel.

In an alternative form, the one or more clearing members may be adapted to rotate, preferably around a common shaft. Each of the one or more clearing members may have a plurality of finger members, preferably disposed radially around an axis of the shaft.

Preferably, the collecting apparatus further comprises a cutting head. Typically the cutting head is a drum shearer head. The cutting head is preferably arranged in front of the plurality of discs with respect to a forward direction of travel.

Preferably, the collecting apparatus is mobile. Preferably the collecting apparatus drives on the seafloor. More preferably the collecting apparatus is track mounted.

In another form, the invention resides in a method of preventing debris from blocking a slurry inlet, the method including the step of rotating a plurality of discs relative to one or more clearing members such that debris lodged between respective adjacent discs is dislodged by the one or more clearing members.

Preferably the debris is seafloor material over a predetermined size, or oversize. Preferably seafloor material under the predetermined size is passed through the plurality of discs to the slurry inlet unhindered by the one or more clearing members.

In a form, the method further includes the step of rotating the at least one clearing member. Preferably the clearing member is rotated in the same direction as the plurality of discs.

Further, the present invention provides a collecting apparatus adaptable in some embodiments to deployment at significant water depths. For example some embodiments may be operable at depths greater than about 400 m, more preferably greater than 1000 m and more preferably greater than 1500 m depth. Nevertheless it is to be appreciated that some embodiments of the present invention may also present a useful seafloor mining option in water as shallow as 100 m or other relatively shallow submerged applications. Accordingly it is to be appreciated that references to the seafloor or seabed are not intended to exclude application of the present invention to mining or excavation of lake floors, estuary floors, fjord floors, sound floors, bay floors, harbour floors or the like, whether in salt, brackish, or fresh water, and such applications are included within the scope of the present specification.

Further features of the present invention will become apparent from the following detailed description.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE DRAWINGS

Figure 1:
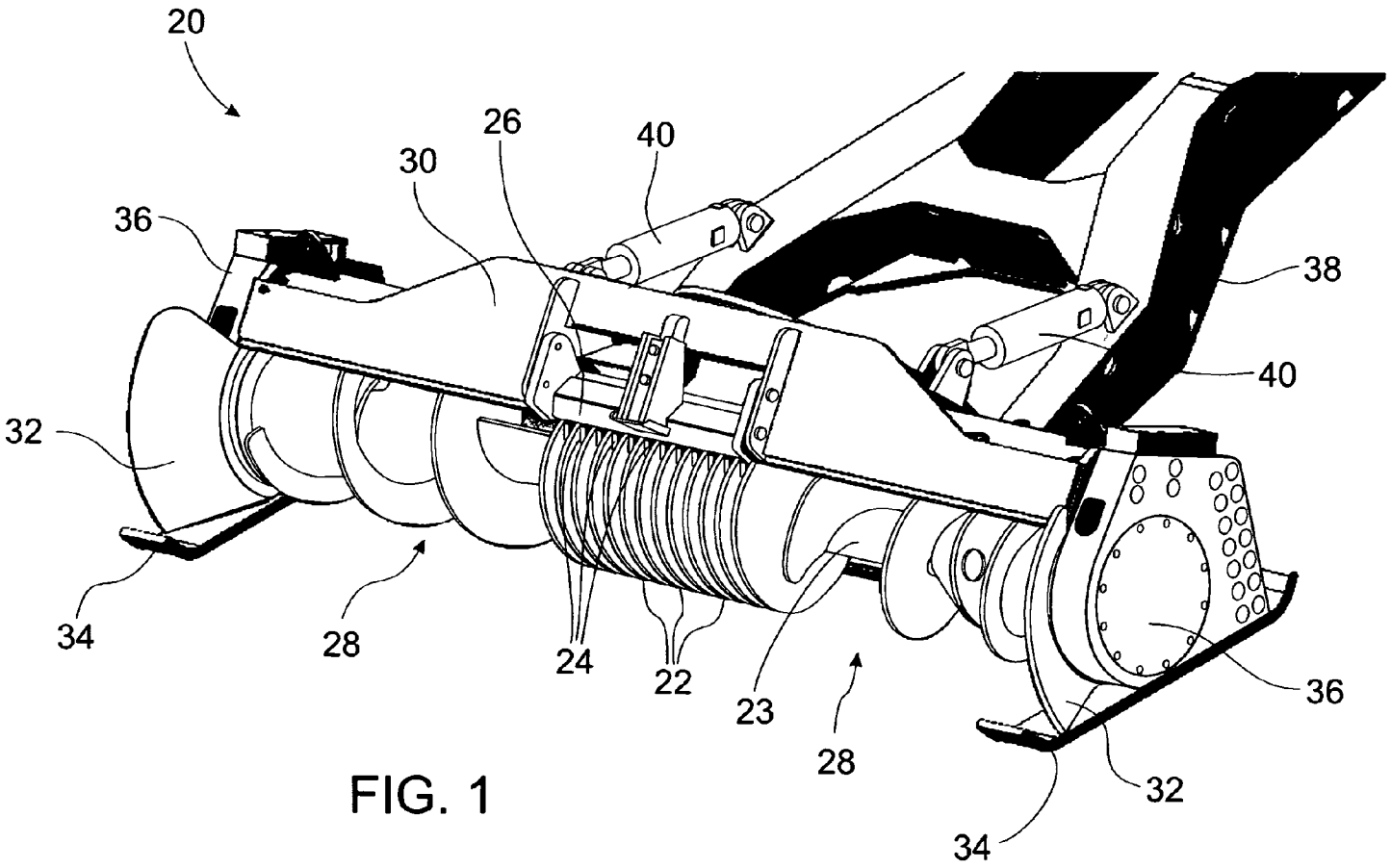
FIG. 1 shows a perspective view of a collecting portion of an embodiment of the invention.

With reference to FIGS. 1, 2, 3, and 4 of the drawings, there is shown a collecting portion 20 of a collecting apparatus. The collecting portion 20 comprises a plurality of discs 22 disposed in front of a slurry suction pipe 21 (not shown in FIGS. 1 and 2, see FIGS. 5 and 6) positioned to receive seafloor material from the plurality of discs 22. Clearing members 24, in the form of fingers, are disposed between the discs 22 with a single clearing member 24 being arranged between each adjacent pair of discs 22.

Figure 2:
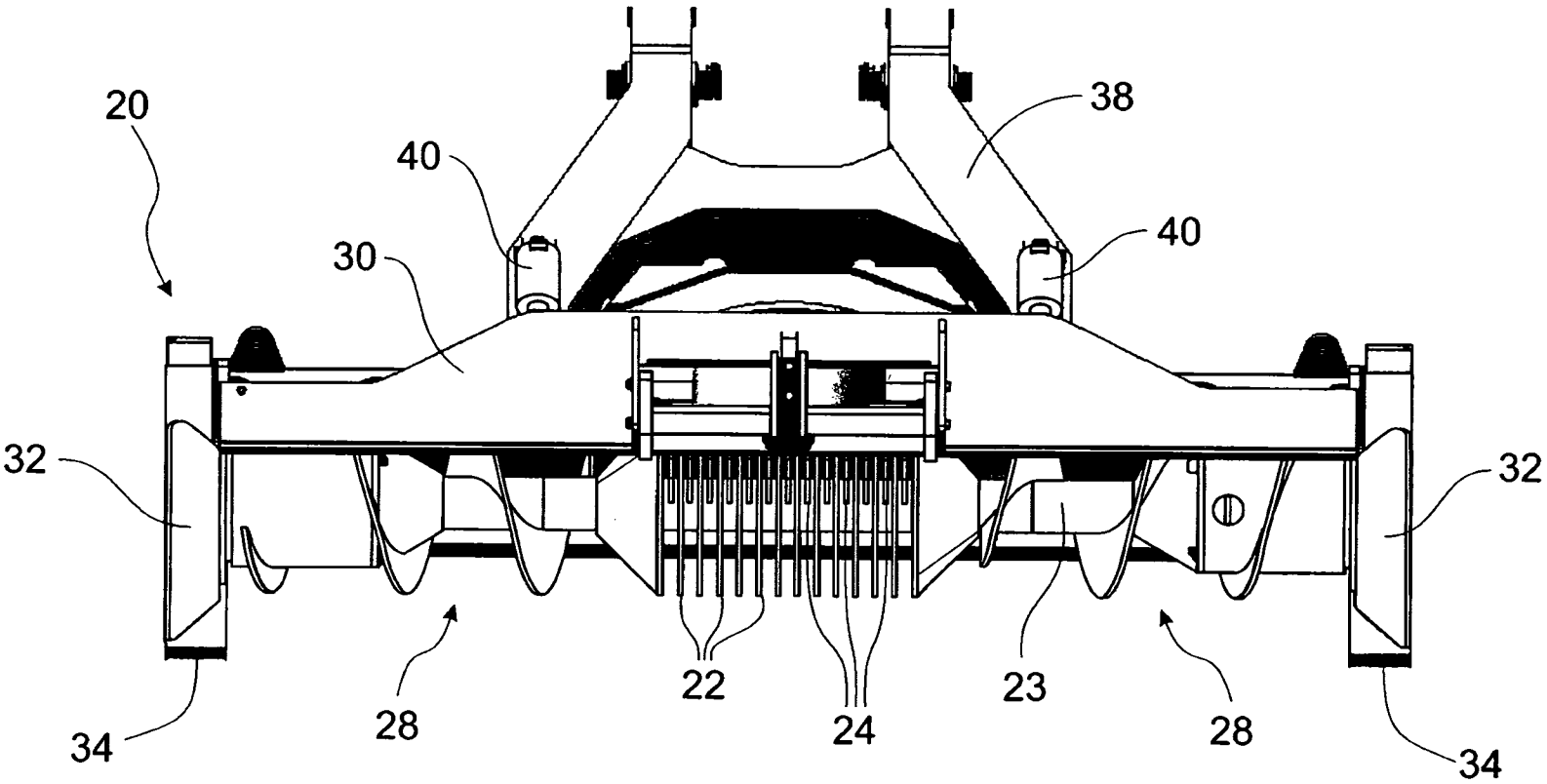
FIG. 2 shows a front elevation view of the collecting portion of an embodiment of the invention shown in FIG. 1.

The discs 22 are attached to a central shaft 23 (seen most clearly in FIG. 2). The central shaft 23 is connected to motors 36 which are attached to a frame 30. Augers 28 are attached to the central shaft 23 on either side of the discs 22. Augers 28 are arranged such that in use, when the central shaft 23 is rotating, nearby material is urged by the augers 28 inwards towards the plurality of discs 24 and slurry suction pipe 21.

The clearing members 24 are attached to a support member 26 which is secured to the frame 30. Together the clearing members 24 and the support member 26 form a clearing comb. In an embodiment the clearing members 24 are fingers that are integral with the support member 26.

The frame 30 comprises deflectors 32. Skids 34 are attached to the frame 30 and the deflectors 32.

The frame 30 is pivotably attached to a support arm 38. Cylinders 40 are attached between the support arm 38 and the frame 30. Cylinders 40 are connected such that they can be utilised to adjust the angle of the frame 30 relative to the support arm 38.

Figure 4:
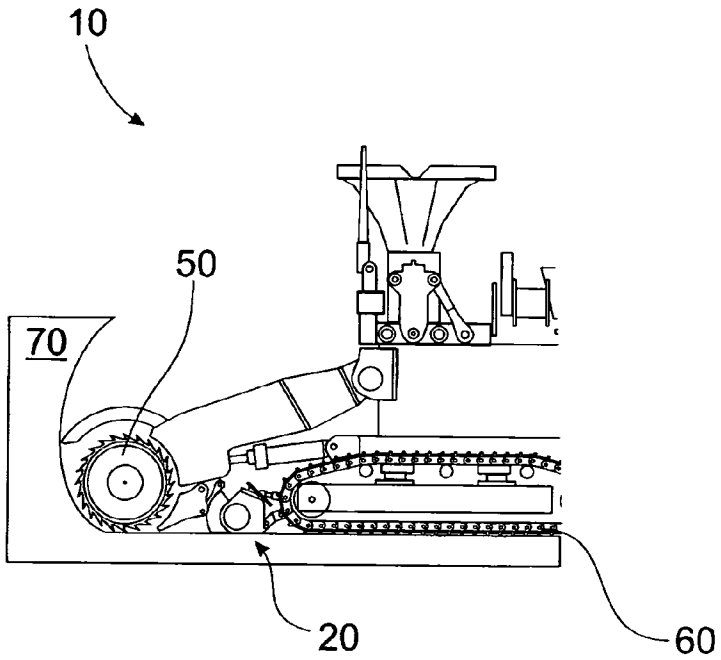
FIG. 4 shows a schematic side elevation view of the embodiment of the invention shown in FIG. 3 in a different position.
Figure 3:
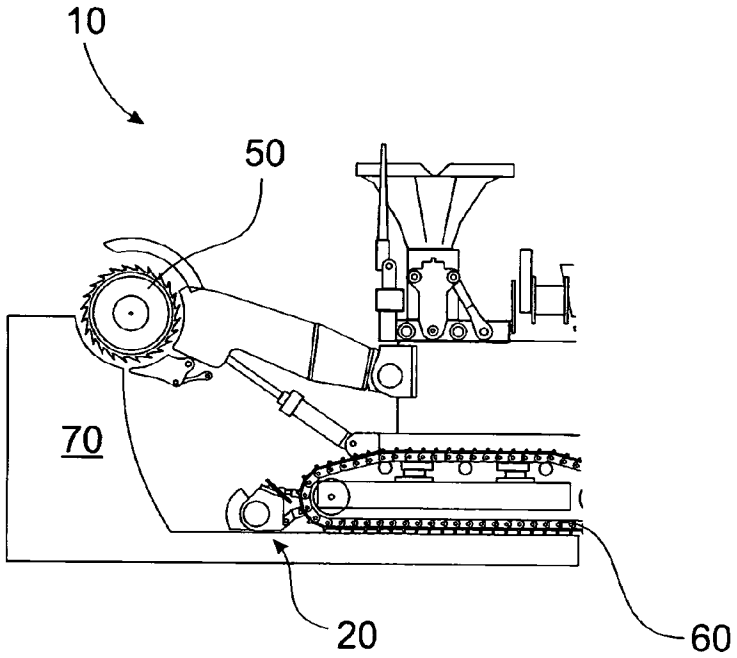
FIG. 3 shows a schematic side elevation view of an embodiment of the invention.

FIGS. 3 and 4 show the collecting apparatus 10 having a collecting portion 20 adjacent to the seafloor 70. The collecting apparatus 10 further comprises a cutting head 50. FIG. 3 shows the cutting head 50 in an upper position and FIG. 4 shows the cutting head 50 in a lower position. The collecting apparatus 10 further comprises tracks 60 such that the collecting apparatus 10 can traverse the seafloor 70.

Figure 5:
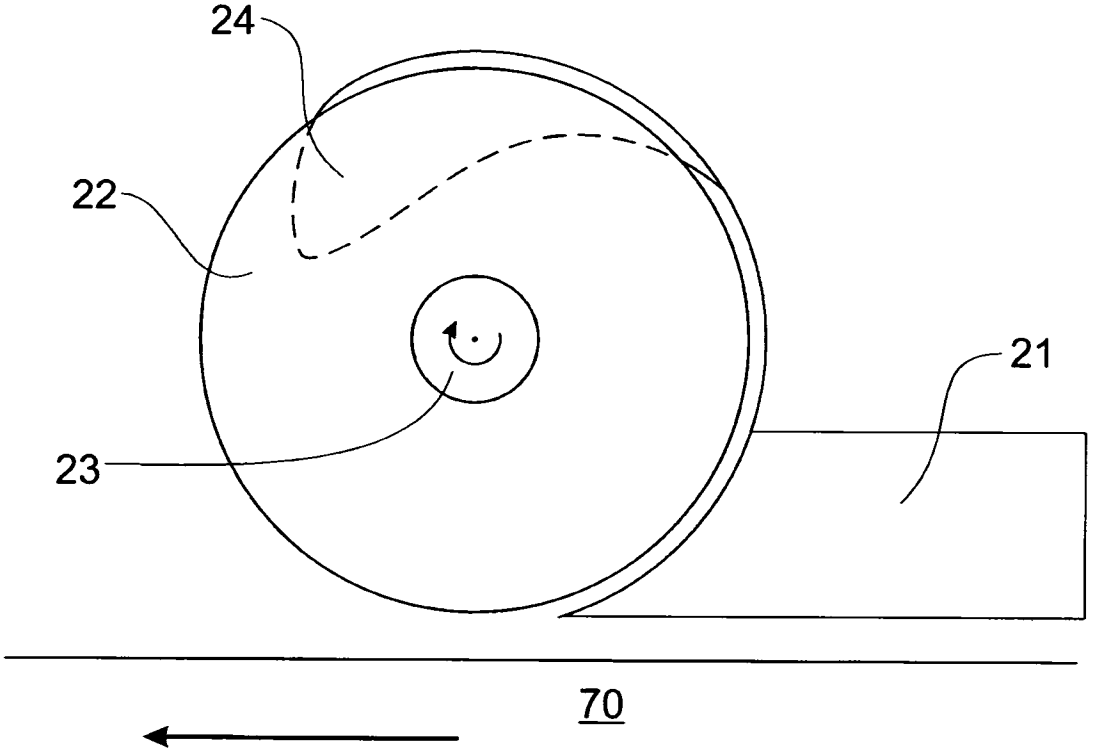
FIG. 5 shows a schematic section view of a collecting portion of an embodiment of the invention.

FIG. 5 illustrates a section view of the collection portion 20 showing a single disc 22 attached to the central shaft 23. The clearing member 24 is configured such that it is located between adjacent discs 22 in front of a rear housing panel and slurry suction pipe 21. The location of the clearing member 24 and discs 22 relative to the slurry suction pipe 21 limits the size of any particles which can enter the slurry suction pipe 21.

In use with reference to FIGS. 1 to 5, the collecting apparatus 10 is located on the seafloor 70. The collecting apparatus 10 is typically remotely operated, for example from a surface vessel or platform (not shown). It will be appreciated that the collecting apparatus 10 may operate autonomously.

The collecting apparatus 10 traverses the seafloor 70 while the cutting head 50 is moved along the seafloor 70 processing portions of the seafloor 70 into cuttings (not shown) suitable for transport as slurry. As illustrated in FIGS. 3 and 4, the cutting head 50 can be manoeuvred, for example upwards and downwards, to process larger portions of the seafloor 70 at a time. The processed cuttings fall downwards and land on the seafloor 70 in front of the collecting portion 20.

As the collecting apparatus 10 is moved forward by tracks 60, the collecting portion 20 collects the cuttings from the seafloor 70. The collecting portion 20 'rides' over the seafloor 70 on skids 34 as the collecting apparatus 10 is moved forward. The angle of the frame 30 relative to the support arm 38 can be adjusted by extension or retraction of the cylinders 40 to accommodate changes in the seafloor 70.

The deflectors 32 of the collecting portion 20 are adapted to deflect the cuttings inwards towards the augers 28 and the discs 22. The augers 28 and the discs 22 are rotated by motors 36. Rotation of the augers 28 urges the cuttings around the augers 28 inwards towards the discs 22.

The slurry suction pipe 21 draws loose seafloor material, including the cuttings, together with seawater to form slurry which is transferred via a slurry transfer pipe (not shown) from the collecting apparatus 10 to another location such as a riser or stockpile site.

The loose seafloor material is drawn through the spaces between the discs 22 and into the slurry suction pipe 21. The cutting head 50 is typically arranged to produce cuttings of a predetermined size, or at least cuttings that are no larger than a predetermined size. Nevertheless, oversize material (debris over a predetermined size) which may be from the seafloor or the cuttings, can become lodged between adjacent discs 22. As the discs 22 rotate, the oversize material is lifted with the discs 22 to the clearing members 24 and the clearing members 24 dislodge the oversize material from the discs 22. The dislodged oversize material passes over the top of the clearing members 24 and support member 26, allowing for the collection device to continue collecting despite the presence of oversize material and without the oversize material gathering in front of the collection device. The oversize material may be processed on further passes of the collecting apparatus 10.

Figure 6:
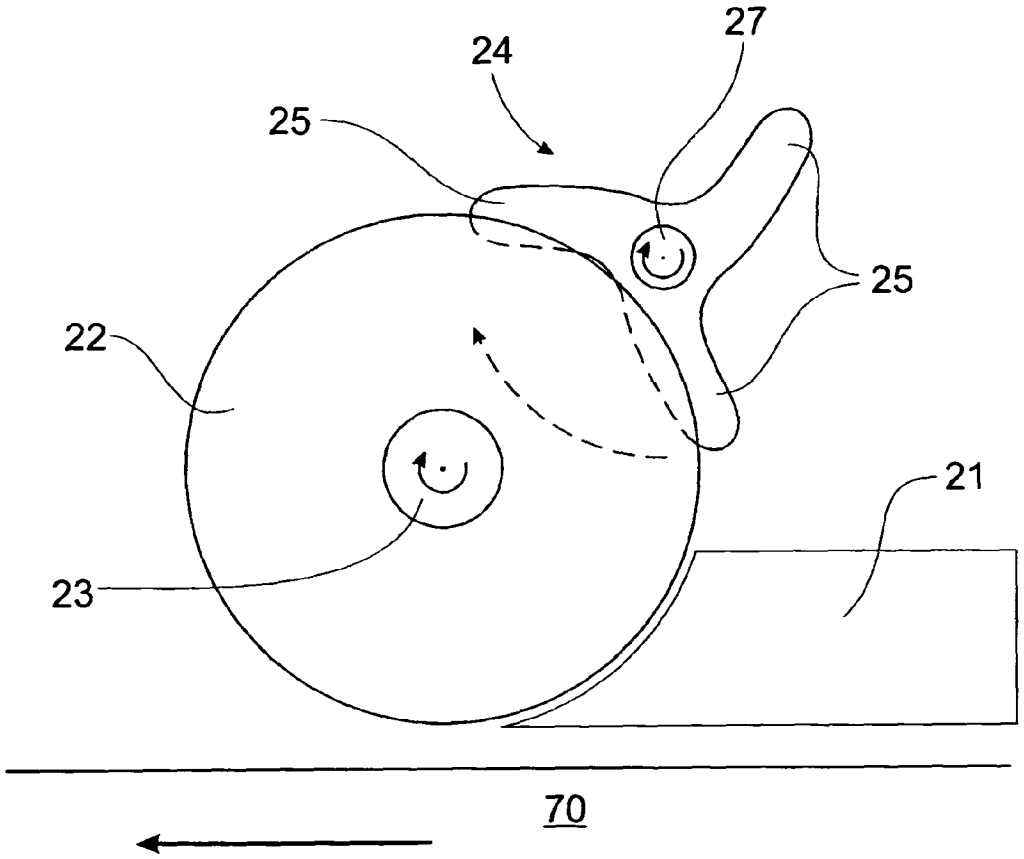
FIG. 6 shows a schematic section view of a collection portion of an alternative embodiment of the invention.

With reference to FIG. 6, there is shown a cross sectional schematic view showing a disc 22 and clearing member 24 according to an alternative embodiment of the invention. The clearing member 24 has three finger members 25 which extend radially around a shaft 27. It will be appreciated that typically there are a plurality of clearing members 24 attached to the shaft 27 and each clearing member 24 is located at least partially between an adjacent pair of discs 22.

In use, with reference to FIG. 6, slurry is drawn through the spaces between discs 22 and into the slurry suction pipe 21. Discs 22 and clearing members 24 (only one shown in FIG. 6) both rotate in a clockwise direction. Any oversize material which becomes lodged between adjacent discs 22 will rotate with the discs 22. Once the oversize material (not shown) rotates with the discs 22 to the clearing members 24, the finger members 25 of the clearing members 24 dislodge and lift out the oversize material from the discs 22 as the finger members 25 rotate.

Advantageously, the invention provides an apparatus and method for collecting seafloor material that filters oversize material (i.e. debris over a predetermined size) from entering the slurry suction pipe. Furthermore, the discs 22 are self cleaning via their relationship with the clearing members 24 which significantly reduces the likelihood of blockages occurring and/or the need for maintenance to be conducted due to oversize material. The invention improves efficiency and increases the reliability of collection machines, resulting in an improvement to seafloor mining operations.

Throughout the specification the aim has been to describe the invention without limiting the invention to any one embodiment or specific collection of features. Persons skilled in the relevant art may realise variations from the specific embodiments that will nonetheless fall within the scope of the invention. For example, individual features from one embodiment may be combined with another embodiment.

It will be appreciated that various other changes and modifications may be made to the embodiment described without departing from the spirit and scope of the invention.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The invention claimed is:

1. A collecting apparatus that operates on a seafloor, the apparatus comprising:

a plurality of discs disposed in front of a slurry suction pipe; and one or more clearing members, each of the one or more clearing members being located at least partially between adjacent discs of the plurality of discs;

wherein the one or more clearing members are arranged such that material over a predetermined size is passed over the top of the clearing members and plurality of discs such that it falls behind the collecting apparatus, and wherein the plurality of discs form a one-dimensional grille having a plurality of parallel slots extending across the discs disposed in front of the slurry suction pipe.

2. The collecting apparatus of claim 1, wherein the plurality of discs are attached to a shaft.

3. The collecting apparatus of claim 2, wherein the shaft is operatively connected to at least one motor.

4. The collecting apparatus of claim 2, wherein the plurality of discs are spaced uniformly along at least a portion of the shaft.

5. The collecting apparatus of claim 4, wherein adjacent discs of the plurality of discs are spaced from one another at a predetermined distance corresponding to a predetermined maximum size of material to be drawn into the slurry suction pipe.

6. The collecting apparatus of claim 2, further comprising at least one auger attached to the shaft adjacent to the plurality of discs.

7. The collecting apparatus of claim 6, wherein the auger is arranged to urge material parallel to the axis of the shaft toward the plurality of discs.

8. The collecting apparatus of claim 6, wherein two augers are attached to the shaft in an opposed configuration with one auger on either side of the plurality of discs.

9. The collecting apparatus of claim 1, wherein the plurality of discs are located adjacent a rear housing panel that limits the particle size drawn into the slurry suction pipe.

10. The collecting apparatus of claim 1, wherein one clearing member is disposed between each pair of adjacent discs.

11. The collecting apparatus of claim 1, wherein each clearing member is in the form of a finger.

12. The collecting apparatus of claim 11, wherein the fingers are integrally formed with a support member to form a clearing comb.

13. The collecting apparatus of claim 12, wherein the clearing comb is mounted in front of the slurry inlet with respect to a forward direction of travel.

14. The collecting apparatus of claim 1, wherein the one or more clearing members are adapted to rotate around a common shaft.

15. The collecting apparatus of claim 14, wherein the one or more clearing members have a plurality of finger members disposed radially around an axis of the common shaft.

16. The collecting apparatus of claim 1, wherein the collecting apparatus is track mounted and drives on the seafloor.

17. The collecting apparatus of claim 1, wherein the collecting apparatus further comprises a cutting head.

18. The collecting apparatus of claim 17, wherein the cutting head is arranged in front of the plurality of discs with respect to a forward direction of travel.

19. A method of preventing debris from blocking an inlet of the slurry suction pump of the collecting apparatus of claim 1, wherein the method includes rotating the plurality of discs relative to the one or more clearing members such that debris lodged between respective adjacent discs is dislodged by the one or more clearing members and passed over the top of the clearing members and plurality of discs such that it falls behind the collecting apparatus.

20. A method of collecting seafloor material, the method including operating the collecting apparatus of claim 1 and collecting seafloor material from the slurry suction pipe of the collecting apparatus.

21. A method of preventing debris from blocking a slurry inlet, the method including rotating a plurality of discs relative to one or more clearing members such that debris lodged between respective adjacent discs is dislodged by the one or more clearing members and passed over the top of the clearing members and plurality of discs such that it falls behind the collecting apparatus, wherein the plurality of discs are arranged to form a one-dimensional grille of parallel slots extending across the discs disposed in front of a slurry suction pipe and the step of rotating the plurality of discs relative to one or more clearing members comprises dislodging debris lodged in the circumferential slots between adjacent discs.

22. The method of claim 21, wherein the debris is seafloor material over a predetermined size.

23. The method of claim 21, further including the step of rotating the one or more clearing members.

24. The method of claim 23, wherein the clearing members are rotated in the same direction as the plurality of discs.

25. The method of claim 20, wherein the seafloor material includes cuttings and the method further includes the step of processing portions of the seafloor into the cuttings using a cutting head.

* * * * *